US007810169B2

(12) United States Patent
Grilliot et al.

(10) Patent No.: US 7,810,169 B2
(45) Date of Patent: Oct. 12, 2010

(54) GARMENT AND MEASURING SCALE COMBINATION

(75) Inventors: William L. Grilliot, Dayton, OH (US); Mary I. Grilliot, Dayton, OH (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/525,620

(22) Filed: Sep. 22, 2006

(65) Prior Publication Data

US 2008/0072360 A1 Mar. 27, 2008

(51) Int. Cl.
*A41D 13/00* (2006.01)

(52) U.S. Cl. ..... 2/69

(58) Field of Classification Search ..... 2/69, 2/69.5, 456, 81, 93, 94, 97, 114, 115, 59, 2/102

See application file for complete search history.

(56) References Cited

U.S. PATENT DOCUMENTS

| | | | | | |
|---|---|---|---|---|---|
| 899,802 | A | | 9/1908 | Pohle | |
| 1,784,888 | A | * | 12/1930 | Couture | 33/2 R |
| 1,790,416 | A | * | 1/1931 | Guillot | 33/14 |
| 2,063,922 | A | * | 12/1936 | Greenberg | 33/2 R |
| 2,069,494 | A | * | 2/1937 | Hurst | 33/2 R |
| 2,109,823 | A | * | 3/1938 | Guillot | 33/2 R |
| 2,537,417 | A | * | 1/1951 | Merske | 206/281 |
| 2,869,236 | A | * | 1/1959 | Franklin | 33/2 R |
| 2,977,684 | A | * | 4/1961 | Campanile | 33/2 R |
| 3,832,780 | A | * | 9/1974 | Lewis | 33/2 R |
| 3,849,886 | A | * | 11/1974 | Weyrick et al. | 33/2 R |
| 4,750,268 | A | * | 6/1988 | Ravid | 33/2 H |
| 5,153,941 | A | * | 10/1992 | Grilliot et al. | 2/98 |
| 5,189,737 | A | * | 3/1993 | Ribicic | 2/93 |
| 5,920,998 | A | * | 7/1999 | Slilaty | 33/512 |
| 6,338,723 | B1 | * | 1/2002 | Carpenter et al. | 602/75 |
| 6,691,317 | B2 | * | 2/2004 | Cochran | 2/97 |
| 7,249,423 | B2 | * | 7/2007 | Sieber | 33/512 |

* cited by examiner

*Primary Examiner*—Tejash Patel
(74) *Attorney, Agent, or Firm*—Wood, Phillips, Katz, Clark & Mortimer

(57) ABSTRACT

A protective garment conforming to NFPA standards is combined with a measuring scale, which is displayed along a portion of the protective garment, such a sleeve, body, or leg, so as to facilitate taking a measurement, while the protective garment is being worn by a person. In a preferred mode for carrying out this invention, the measuring scale facilitates taking a measurement, while the garment of the combination is being worn by each person in a series of persons, to facilitate tailoring a similar garment for each person in the series of persons. In an alternative mode for carrying out this invention, the measuring scale facilitates taking a measurement, while the garment of the combination is being worn by just one person, to facilitate tailoring the garment of the combination to fit such one person.

5 Claims, 1 Drawing Sheet

GARMENT AND MEASURING SCALE COMBINATION

TECHNICAL FIELD OF THE INVENTION

This invention pertains to tailoring of a garment, which may be a protective garment of a type worn by firefighters and by emergency rescue workers, particularly but not exclusively along the body of the garment, along the sleeves of the garment, if the garment has sleeves, and among the legs of the garment, if the garment has legs.

BACKGROUND OF THE INVENTION

Typically, a protective garment of a type worn by firefighters and by emergency rescue workers conforms to National Fire Protection Association (NFPA) standards, as exemplified by NFPA 1971 (2000) the disclosure of which is incorporated herein by reference.

If the protective garment is a protective coat, a protective jacket, or a suit of protective coveralls, the protective garment has a body and two sleeves. If the protective garment is a pair of protective pants, a suit of protective overalls, or a suit of protective coveralls, the protective garment has a body and two legs.

Typically, a protective garment of the type noted above has an outer shell, an intermediate liner providing a moisture barrier, and an inner liner providing a thermal barrier, whereupon tailoring of the protective garment can be quite difficult.

SUMMARY OF THE INVENTION

This invention provides a combination of a garment and a measuring scale, which is displayed along a portion of the garment, such as a sleeve, back, or leg of the garment. The measuring scale is unitized with the portion of the garment displayed along the portion of the garment so as to facilitate taking a measurement, which the garment of the combination is being worn by a person, either to facilitate tailoring a similar garment, in a preferred mode for carrying out this invention, or to facilitate tailoring the garment of the combination, in an alternative mode for carrying out this invention.

In the preferred mode for carrying out this invention, the measuring scale facilitates taking a measurement, while the garment of the combination is being worn by each person in a series of persons, to facilitate tailoring a similar garment to fit each person in the series of persons. In the alternative mode for carrying out this invention, the measuring scale facilitates taking a measurement, while the garment of the combination is being worn by just one person, to facilitate tailoring the garment of the combination to fit said one person.

Preferably, the measuring scale is provided by a measuring tape, which is attached via stitching, adhesively, or otherwise to and along the portion of the garment. For the preferred mode for carrying out this invention, the measuring tape may be advantageously attached so as not to be readily detachable. For the alternative mode for carrying out this invention, the measuring tape may be advantageously attached so as to be readily detachable.

This invention can be advantageously practiced if the garment is a protective garment of a type worn by firefighters and by emergency rescue workers, and conforming to NFPA 1971 (2000) standards, but this invention can be also practiced for a garment conforming to different standards or for a garment of a different type.

DETAILED DESCRIPTION OF THE ILLUSTRATED EMBODIMENTS

Figure 1:
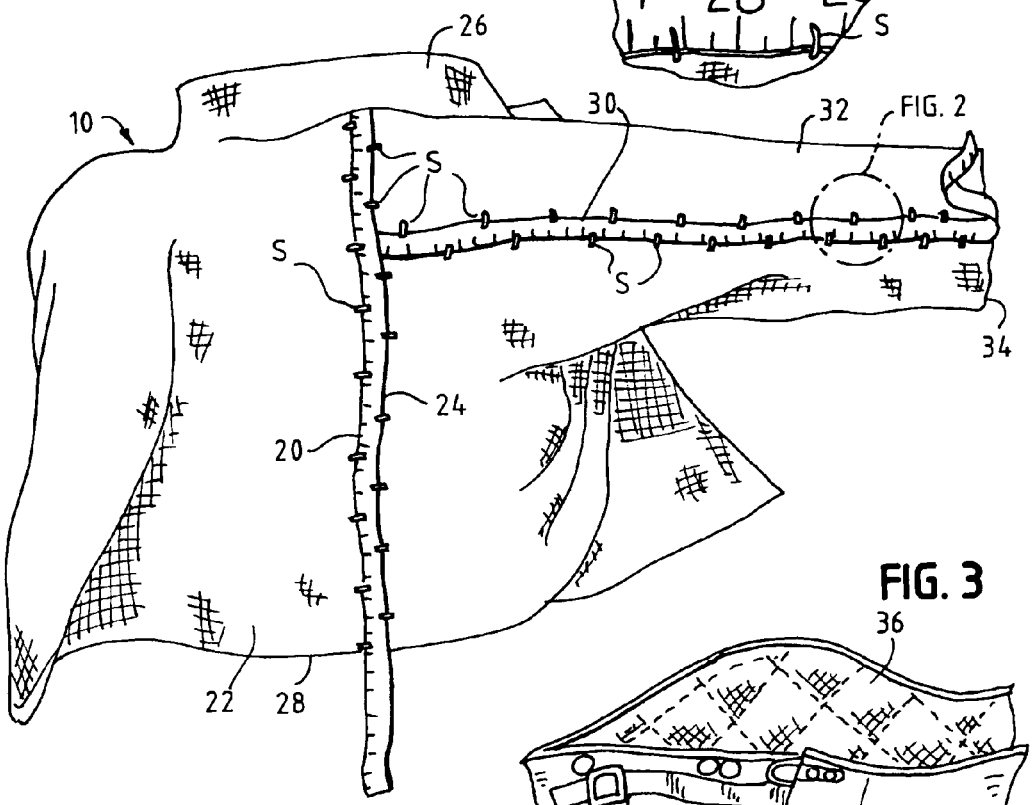
FIG. 1 is a pictorial view of a protective coat, a measuring tape attached to and along a back of the protective coat, and a measuring tape attached to and along a sleeve of the coat, in a first contemplated embodiment of this invention.

In the first embodiment of this invention, as illustrated in FIG. 1, a protective coat 10 of a type worn by firefighters and by emergency rescue workers and conforming to NFPA 1971 (2000) standards comprises an outer shell, an intermediate liner providing a moisture barrier, and an inner liner providing a thermal barrier.

As provided by this invention, the protective coat 10 is combined with flexible measuring tapes, which are unitized with the outer shell of the protective coat by being attached to the outer shell of the protective coat 10, via stitches S, as illustrated, adhesively, or otherwise, and which facilitate taking of measurements, while the protective coat 10 is being worn by each person in a series of persons or by just one person, either to facilitate tailoring a protective coat similar to the protective coat 10 to fit each person in the series of persons, in the preferred mode for carrying out this invention, or to facilitate tailoring the protective coat 10 to fit said one person, in the alternative mode for carrying out this invention.

In the first mode for carrying out this invention, the measuring tapes are attached to the outer shell of the protective coat 10 so as not to be readily removable. In the second mode for carrying out this invention, the measuring tapes are attached to the outer shell of the protective coat 10 so as to be readily removable.

Thus, a measuring tape 20 is attached to and along an exterior surface of a body 22 of the protective coat 10, along a back midline 24, between a collar 26 of the protective coat 10 and a lower edge 28 of the protective coat 10. The measuring tape 20 facilitates tailoring the body of a protective coat similar to the protective coat 10 to fit each person in the series of persons, in the preferred mode for carrying out this invention. The measuring tape 20 facilitates tailoring the body 22 of the protective coat 10 to fit said one person, in the alternative mode for carrying out this invention.

Also, a measuring tape 30 is attached to and along an exterior surface of each sleeve 32 of the protective coat 10, between the back midline 24 and a cuff end 34 of said sleeve 32. The measuring tapes 30 facilitate tailoring each sleeve of a protective coat similar to the protective coat 10, in the preferred mode for carrying out this invention. The measuring tapes 30 facilitate tailoring each sleeve 32 of the protective coat 10, in the alternative mode for carrying out this invention.

Similar measuring tapes to be similarly utilized may be similarly attached along or around other portions of the protective coat 10, such as the cuff end 34 of each sleeve 32 or the collar portion 36 of the protective coat 10.

Figure 3:
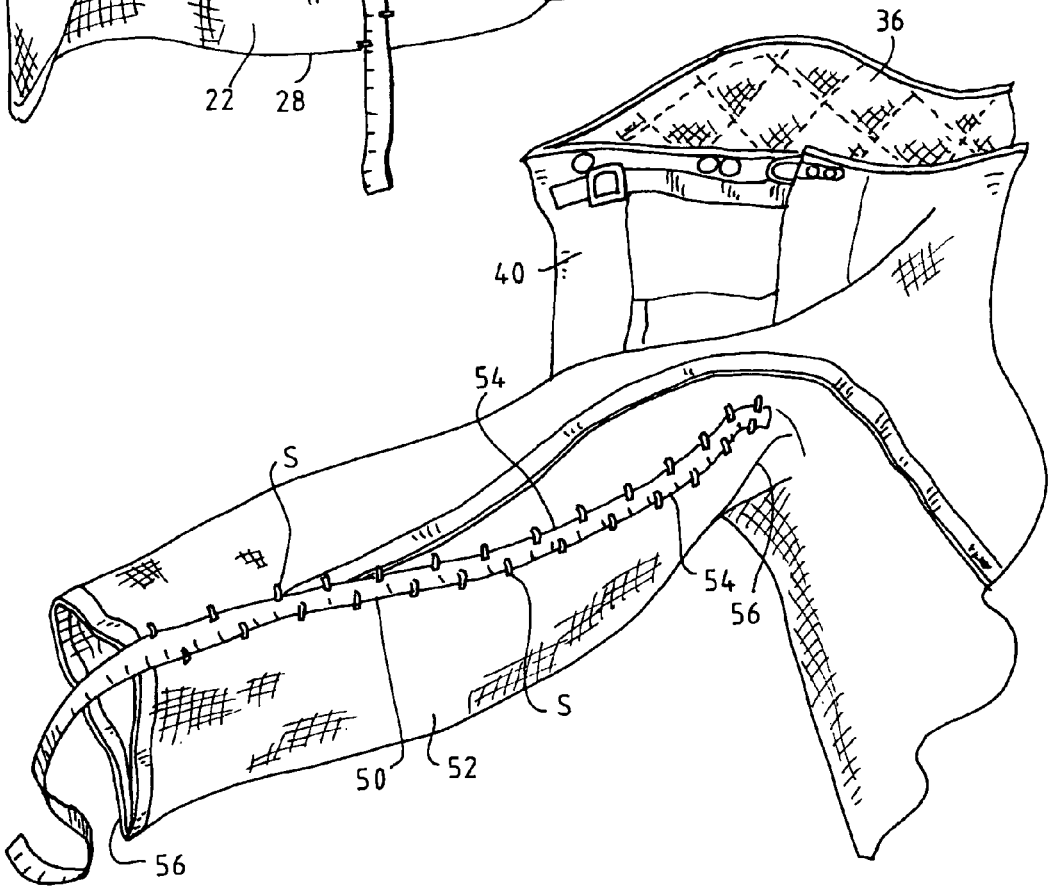
FIG. 3 is a pictorial view of a pair of protective pants and a measuring tape attached to and along a leg of the pair of protective pants, in a second embodiment of this invention.

In the second embodiment of this invention, as illustrated in FIG. 3, a pair of protective pants 40 of a type worn by firefighters and by emergency rescue workers and conforming to NFPA 1971 (2000) standards comprises an outer shell, an intermediate liner providing a moisture barrier, and an inner liner providing a thermal barrier.

As provided by this invention, the pair of protective pants 40 is combined with flexible measuring tapes, which are unitized with the outer shell of the pair of protective pants 40 by being attached to the outer shell of the pair of protective pants 40, via stitches S, as illustrated, adhesively, or otherwise, which facilitate taking a measurement while the pair of protective pants 40 is being worn by each person in a series of persons or by just one person, either to facilitate tailoring of a pair of protective pants similar to the pair of protective pants 40 to fit each person in the series of persons, in the preferred mode for carrying out this invention, or to facilitate tailoring of the pair of protective pants 40 to fit said one person, in the alternative mode for carrying out this invention.

In the first mode for carrying out this invention, the measuring tapes are attached to the outer shell of the pair of protective pants 40 so as not to be readily removable. In the second mode for carrying out this invention, the measuring tapes are attached to the outer shell of the pair of protective pants 40 so as not to be readily removable.

Thus, a measuring tape 50 is attached to and along an exterior surface of each leg 52 of the pair of protective pants 40, along an inseam 54 of said leg 52, between a crotch 56 of the pair of protective pants 40 and a cuff end 56 of said leg 52. The measuring tapes 50 facilitate tailoring each leg of a pair of protective pants similar to the protective pants 50 to fit each person in the series of persons, in the preferred mode for carrying out this invention. The measuring tapes 50 facilitate tailoring each leg 52 of the pair of protective pants 50 to fit said one person, in the alternative mode for carrying out this invention.

Similar measuring tapes to be similarly utilized may be similarly attached along or around other portions of the protective pants 40, such as the cuff end 56 of each leg 52 or the waist portion 36 of the protective pants 40.

The first and second embodiments of this invention can be advantageously combines in a suite of protective garments, which comprise the protective coat 10 and the pair of protective pants 40.

Figure 2:
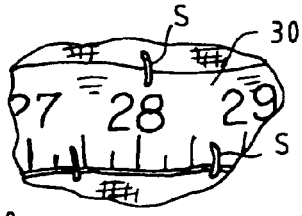
FIG. 2, on a larger scale, is a fragmentary cross-section taken in a region encircled in broken lines, in FIG. 1.

In the first and second embodiments of this invention, each measuring tape 20, 30, 50, may be advantageously made from paper, woven cloth, nonwoven cloth, metal foil, or polymeric foil. Each measuring tape 20, 30, 50, is marked with a measuring scale in full and fractional inches, as illustrated in FIG. 2, in full and fractional centimeters, or in any other convenient measurements.

In simplified embodiments of this invention, a measuring scale corresponding functionally to the measuring scale of each measuring tape 20, 30, 50, is unitized with the outer shell of the protective garment by being imprinted directly on and along the outer shell of the protective garment. Desirably, in the first mode for carrying out this invention, the measuring scales are imprinted in permanent ink. Desirably, in the second mode for carrying out this invention, the measuring scales are imprinted in washable ink.

The invention claimed is:

1. A combination comprising a garment and a measuring scale, which is unitized with a portion of the garment and which is displayed along the portion of the garment so as to facilitate taking a measurement, while the garment is being worn by a person, to facilitate tailoring of the garment or a similar garment to fit the person, wherein the measuring scale is imprinted directly on and along the portion of the garment, wherein the garment is one of a protective coat or a protective pant.

2. A combination comprising a garment and a measuring scale, which is unitized with a portion of the garment and which is displayed along the portion of the garment so as to facilitate taking a measurement, while the garment is being worn by a person, to facilitate tailoring of the garment or a similar garment to fit the person, wherein the measuring scale is imprinted directly on and along the portion of the garment, wherein the garment is a protective garment conforming to NFPA standards for protective garments.

3. The combination of claim 1, wherein the portion of the protective garment is a sleeve of the protective garment, and the measuring scale extends along the length of the sleeve and is configured to measure the appropriate sleeve length for the person wearing the garment.

4. The combination of claim 1, wherein the portion of the protective garment is a back of the protective garment.

5. The combination of claim 1, wherein the portion of the protective garment is a leg of the protective garment, and the measuring scale extends along the length of the leg and is configured to measure the appropriate leg length for the person wearing the garment.

* * * * *